US011879211B2

(12) United States Patent
Nunes et al.

(10) Patent No.: US 11,879,211 B2
(45) Date of Patent: Jan. 23, 2024

(54) PROCESS FOR SEPARATING TRICHOMES FROM NON-TRICHOME MATERIALS

(71) Applicant: The Procter & Gamble Company, Cincinnati, OH (US)

(72) Inventors: Raul Victorino Nunes, Loveland, OH (US); Nicholas William Geary, Mariemont, OH (US); Jason Allen Stamper, Covington, KY (US); Bryan Keith Waye, Mason, OH (US); Khosrow Parviz Mohammadi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/895,570

(22) Filed: Aug. 25, 2022

(65) Prior Publication Data

US 2022/0403595 A1 Dec. 22, 2022

Related U.S. Application Data

(63) Continuation of application No. 16/452,579, filed on Jun. 26, 2019.

(60) Provisional application No. 62/691,836, filed on Jun. 29, 2018.

(51) Int. Cl.
*D21D 5/02* (2006.01)

(52) U.S. Cl.
CPC ..... *D21D 5/02* (2013.01)

(58) Field of Classification Search
CPC ..... D21D 5/02
USPC ..... 162/55
See application file for complete search history.

(56) References Cited

U.S. PATENT DOCUMENTS

| | | | |
|---|---|---|---|
| 3,863,428 | A | 2/1975 | Baxter |
| 3,994,771 | A | 11/1976 | Morgan, Jr. et al. |
| 5,772,847 | A | 6/1998 | Simpson et al. |
| 6,576,083 | B2 | 6/2003 | Franks et al. |
| 6,893,473 | B2 | 5/2005 | Neogi et al. |
| 7,691,472 | B2 | 4/2010 | Vinson et al. |
| 7,811,613 | B2 | 10/2010 | Vinson et al. |
| 8,029,645 | B2 | 10/2011 | Mohammadi |
| 8,056,841 | B2 | 11/2011 | Vinson et al. |
| 8,297,543 | B2 | 10/2012 | Vinson et al. |
| 8,425,722 | B2 | 4/2013 | Mohammadi |
| 8,623,176 | B2 | 1/2014 | Vinson et al. |

(Continued)

FOREIGN PATENT DOCUMENTS

| | | | |
|---|---|---|---|
| JP | H04329913 | A | 11/1992 |
| WO | 2004044320 | A2 | 5/2004 |

(Continued)

OTHER PUBLICATIONS

All Office Actions; U.S. Appl. No. 14/963,278, filed on Dec. 9, 2015.

(Continued)

*Primary Examiner* — Jacob T Minskey
(74) *Attorney, Agent, or Firm* — Richard L. Alexander; Andrew J. Mueller

(57) ABSTRACT

A process for separating trichomes from non-trichome materials, and more particularly to a process for separating trichomes that utilizes an aeration step, trichomes produced therefrom, and fibrous structures produced using such trichomes are provided.

20 Claims, 3 Drawing Sheets

(56) References Cited

U.S. PATENT DOCUMENTS

| | | | | |
|---|---|---|---|---|
| 8,808,501 | B2 | 8/2014 | Vinson et al. | |
| 9,011,641 | B2 | 4/2015 | Mohammadi et al. | |
| 9,718,065 | B1 | 8/2017 | Cilia | |
| 10,227,729 | B2 | 3/2019 | Mohammadi et al. | |
| 10,309,057 | B2 | 6/2019 | Mohammadi et al. | |
| 10,344,428 | B2 | 7/2019 | Mohammadi et al. | |
| 11,098,451 | B2 | 8/2021 | Mohammadi et al. | |
| 11,180,888 | B2 | 11/2021 | Geary et al. | |
| 11,427,960 | B2 | 8/2022 | Green et al. | |
| 2003/0208859 | A1 | 11/2003 | Neogi et al. | |
| 2004/0221975 | A1 | 11/2004 | Hernandez-munoa et al. | |
| 2004/0250969 | A1 | 12/2004 | Luu et al. | |
| 2005/0274470 | A1 | 12/2005 | Shannon et al. | |
| 2006/0069069 | A1 | 3/2006 | Kajander et al. | |
| 2006/0154832 | A1 | 7/2006 | Peltier | |
| 2006/0260002 | A1 | 11/2006 | Ronen et al. | |
| 2006/0288639 | A1 | 12/2006 | Vinson et al. | |
| 2007/0011762 | A1* | 1/2007 | Vinson | D21H 11/12 800/278 |
| 2009/0054858 | A1 | 2/2009 | Cheng et al. | |
| 2009/0084513 | A1 | 4/2009 | Barnholtz et al. | |
| 2010/0239843 | A1 | 9/2010 | Luu et al. | |
| 2011/0104419 | A1 | 5/2011 | Barnholtz et al. | |
| 2011/0168342 | A1 | 7/2011 | Mohammadi | |
| 2011/0226430 | A1 | 9/2011 | Mohammadi | |
| 2013/0215995 | A1 | 8/2013 | Genik | |
| 2013/0220563 | A1 | 8/2013 | Mohammadi | |
| 2014/0083637 | A1 | 3/2014 | Vinson et al. | |
| 2014/0138040 | A1 | 5/2014 | Sartini et al. | |
| 2014/0141203 | A1 | 5/2014 | Sartini et al. | |
| 2015/0094252 | A1* | 4/2015 | Cuyubamba | C11D 17/003 510/404 |
| 2015/0176216 | A1 | 6/2015 | Ostendorf et al. | |
| 2015/0211186 | A1 | 7/2015 | Mcneil et al. | |
| 2015/0337496 | A1 | 11/2015 | Lee | |
| 2016/0160439 | A1 | 6/2016 | Mohammadi et al. | |
| 2017/0175332 | A1 | 6/2017 | Mohammad et al. | |
| 2017/0175338 | A1 | 6/2017 | Mohammadi | |
| 2017/0335512 | A1* | 11/2017 | Mohammadi | D21C 3/003 |
| 2018/0007852 | A1* | 1/2018 | Rose | A01D 91/00 |
| 2020/0002886 | A1 | 1/2020 | Green et al. | |
| 2020/0002889 | A1 | 1/2020 | Nunes et al. | |
| 2021/0348335 | A1 | 11/2021 | Mohammadi et al. | |
| 2022/0042245 | A1 | 2/2022 | Geary et al. | |

FOREIGN PATENT DOCUMENTS

| | | | |
|---|---|---|---|
| WO | 2006137041 | A2 | 12/2006 |
| WO | 2009010939 | A2 | 1/2009 |
| WO | 2009024897 | A2 | 2/2009 |
| WO | 2011053956 | A1 | 5/2011 |

OTHER PUBLICATIONS

All Office Actions; U.S. Appl. No. 15/378,430, filed on Dec. 14, 2016.
All Office Actions; U.S. Appl. No. 15/378,627, filed on Dec. 14, 2016.
All Office Actions; U.S. Appl. No. 15/602,187, filed on May 23, 2017.
All Office Actions; U.S. Appl. No. 16/388,986, filed on Apr. 19, 2019.
All Office Actions; U.S. Appl. No. 16/452,574, filed on Jun. 26, 2019.
All Office Actions; U.S. Appl. No. 16/452,579, filed on Jun. 26, 2019.
All Office Actions; U.S. Appl. No. 16/452,582, filed on Jun. 26, 2019.
All Office Actions; U.S. Appl. No. 16/452,659, filed on Jun. 26, 2019.
All Office Actions; U.S. Appl. No. 17/092,670, filed on Nov. 9, 2020.
All Office Actions; U.S. Appl. No. 17/382,725, filed on Jul. 22, 2021.
All Office Actions; U.S. Appl. No. 17/510,434, filed on Oct. 26, 2021.
All Office Actions; U.S. Appl. No. 17/868,234, filed on Jul. 19, 2022.
Anthon et al. Pectin Methylesterase Activity and Other Factors Affecting PH and Titratable Acidity in Processing Tomatoes; Food Chemistry, vol. 132, pp. 915-920. (Year: 2012).
Atanasova et al. Evolution and Functional Characterization of Pectate Lyase Pel 12, A Member of a Highly Expanded Clonostachys Rosea Polysaccharide Lyase 1 Family; BMC Microbiology, vol. 18, No. 178, pp. 1-19. (Year: 2018).
Daher et al., "How to let go: pectin and plant cell adhesion", Frontiers in Plant Science, vol. 6, Article 523, pp. 1-8, Jul. 14, 2015.
Das, B. Green Way To Recycle Paper; downloaded from: http://www.downtoearth.org.in/news/green-way-to-recycle-paper-39185, pp. 1-3. (Year: 2012).
Dinu et al. Enzymes With New Biochemical Properties in the Pectinolytic Complex Produced By Astergillus Niger MIUG16; Journal of Biotechnology, vol. 131, No. 2, pp. 128-137. (Year: 2007).
Documentation for ImageJ software, National Institute of Health, 3 pages, 2007, online], retrieved from the Internet, [retrieved Jan. 8, 2017], URL:https://imagej.nih.gov/ij/index.html.
James Mauseth, Botany, Oct. 25, 2019, Jones and Bartlett Learning, p. 76 (Year: 2019).
Martins et al., "Purification and Properties of Polygalacturonase Produced by Thermophilic Fungus Thermoascus aurantiacus CBMAI-756 on Solid-State Fermentation", Enzyme Research, vol. 13, Article 438645, pp. 1-7, 2013.
Unpublished U.S. Appl. No. 17/868,234, filed Jul. 19, 2022 to Phillip Richard Green et al.
Zhang, et al., "A Simple and Efficient Method for Isolating Trichomes for Downstream Analyses", Plant and Cell Phys., v 45, No. 2, pp. 221-224. (Year: 2004).
Bourland et al., "Breeding and Genetics", The Journal of Cotton Science, 21, pp. 296-305. (Year: 2017).
Castro et al., "Activity and Process Stability of Purified Green Pepper (*Capsicum annuum*) Pectin Methylesterase"; Journal of Agricultural and Food Chemistry, vol. 52, pp. 5724-5729. (Year: 2004).
Niture et al., "Inactivation of Polygalacturonase and Pectate Lyase Produced by PH Tolerant Fungus *Fusarium moniliforme* NCIM 1276 OM a Liquid Medium and in the Host Tissue"; Microbiological Research, vol. 163, pp. 51-62. (Year: 2008).
Sathiyaraj et al., "Screening and Optimization of Pectin Lyase and Polygalacturonase Activity From Ginseng Pathogen Cylindrocarpon Destructans"; Brazilian Journal of Microbiology, vol. 42, pp. 794-806. (Year: 2011).

* cited by examiner

PROCESS FOR SEPARATING TRICHOMES FROM NON-TRICHOME MATERIALS

CROSS REFERENCE TO RELATED APPLICATIONS

This application is a continuation of, and claims priority under 35 U.S.C. § 120 to, U.S. patent application Ser. No. 16/452,579, filed on Jun. 26, 2019, which claims the benefit, under 35 USC § 119(e), of U.S. Provisional Patent Application Ser. No. 62/691,836, filed on Jun. 29, 2018, the entire disclosures of which are fully incorporated by reference herein.

FIELD OF THE INVENTION

The present invention relates to a process for separating trichomes from non-trichome materials, and more particularly to a process for separating trichomes that utilizes an aeration step, trichomes produced therefrom, and fibrous structures produced using such trichomes.

BACKGROUND OF THE INVENTION

The interest in using non-wood materials, such as trichomes and bamboo fibers, to make fibrous structures, for example sanitary tissue products, has recently increased in light of the continuing efforts relating to sustainability.

One non-wood material that shows promise as a replacement or partial replacement of wood pulp fibers in fibrous structures, such as sanitary tissue products, is trichomes; namely, individualized trichomes derived from plants, such as Lamb's Ear plants (*Stachys byzantina*). However, "clean" individualized trichomes are challenging to obtain in large amounts due to the impurities, such as stems, specks, dirt, clay, sand, rocks, grasses, sticks, and other non-trichome materials that are present with the individualized trichomes as a result of the processes for harvesting and extracting the individualized trichomes from the plants.

The known processes for extracting trichomes from plants typically utilize mechanical cutting and air sorting operations. Such operations are very costly, require high amounts of maintenance, are normally batch processes rather than continuous processes, and the extracted trichomes still contain a level of non-trichome materials, for example specks, sand, stems, that is not consumer acceptable.

Another more recent process for extracting trichomes from plants utilizes a screen, for example a pressure screen, but there is still room for improving the purity of the trichomes.

Accordingly, one problem with known processes for extracting trichomes from plants is the inability to remove non-trichome materials (impurities present in the plants and/or growing environments from which the plants are harvested) cost effectively and/or in a continuous process such that the extracted trichomes contain no or a consumer acceptable level of non-trichome materials so that the extracted trichomes may ultimately be used to make consumer desirable fibrous structures for sanitary tissue products.

Extracting trichomes to sufficient purity levels (minimizing and/or eliminating the non-trichome materials within the extracted trichomes, for example to be substantially free of (less than 5% and/or less than 4% and/or less than 3% and/or less than 2% and/or less than 1% and/or less than 0.5% and/or about 0% by weight of non-trichome materials) non-trichome materials from trichome-bearing plants at commercial volumes has never been achieved prior to the present invention.

Clearly, there is a need for processes that are able to extract trichomes from plants and/or from a mixture of trichomes and non-trichome materials, such as stems, specks, dirt, clay, sand, in a cost effective, low maintenance, continuous process that results in the extracted trichomes having no or a consumer acceptable level of non-trichome materials (impurities present in the plants and/or growing environments from which the plants are harvested) such that the extracted trichomes can be used to make consumer desirable fibrous structures.

SUMMARY OF THE INVENTION

The present invention fulfills the need described above by providing a process for separating trichomes from a mixture of trichomes and non-trichome materials utilizing an aeration step and water to physically separate the trichomes from the non-trichome materials.

One solution to the problem identified above is to separate the trichomes from a mixture of trichome and non-trichome materials using the processes of the present invention, for example by creating a slurry from the mixture by adding a fluid, for example water, to the mixture and then aerating the slurry to physically separate the trichomes from the non-trichome materials within the slurry and then removing the separated trichomes from the aerated slurry such that the removed trichomes ("purified trichomes") are substantially free of (less than 5% and/or less than 4% and/or less than 3% and/or less than 2% and/or less than 1% and/or less than 0.5% and/or about 0% by weight). It has unexpectedly been found that such trichomes may be used to make fibrous structures that are consumer acceptable and substantially free of (less than 5% and/or less than 4% and/or less than 3% and/or less than 2% and/or less than 1% and/or less than 0.5% and/or about 0% by weight) non-trichome materials having an average particle size of 0.0001 $cm^2$ or greater as measured according to the Fibrous Structure Purity Test Method described herein.

In one example of the present invention, a process for extracting trichomes from non-trichome materials, the process comprising the steps of:

a. providing a mixture of trichomes and non-trichome materials;
b. adding water to the mixture to form a slurry;
c. physically separating the trichomes from the non-trichome material by one or more of the following steps: i. aerating the slurry and ii. screening the slurry such that the trichomes physically separate from the non-trichome materials; and
d. removing at least a portion of the trichomes from the slurry, is provided.

In another example of the present invention, a process for separating trichomes from a mixture of trichomes and non-trichome materials, the process comprising the steps of:

a. providing a mixture of trichomes and non-trichome materials; and
b. separating the trichomes from the non-trichome materials to produce extracted trichomes, wherein the extracted trichomes are substantially free of non-trichome materials having an average particle size of 0.0001 $cm^2$ or greater as measured according to the Trichomes Purity Test Method, is provided.

In another example of the present invention, a plurality of extracted trichomes obtained from a process according to the present invention, is provided.

In another example of the present invention, a process for making a fibrous structure, the process comprising the steps of:

a. providing a fiber furnish comprising extracted trichomes according to the present invention;
b. depositing the fiber on a foraminous forming surface to form an embryonic fibrous web; and
c. drying the embryonic fibrous web to form a fibrous structure, is provided.

In still another example of the present invention, a fibrous structure comprising a plurality of extracted trichomes according to the present invention such that the fibrous structure is substantially free of non-trichome materials having an average particle size of 0.0001 $cm^2$ or greater as measured according to the Fibrous Structure Purity Test Method, is provided.

In even another example of the present invention, a fibrous structure comprising a plurality of individualized trichomes and being substantially free of non-trichome materials having an average particle size of 0.0001 $cm^2$ or greater as measured according to the Fibrous Structure Purity Test Method, is provided.

In even another example of the present invention, a fibrous structure comprising the plurality of extracted trichomes produced from the process of the present invention, is provided.

In still yet another example of the present invention, a single or multi-ply sanitary tissue product comprising a fibrous structure according to the present invention is provided.

The present invention provides a process for extracting trichomes from plants that overcomes the negatives of known processes for extracting trichomes from plants, fibrous structures made from such extracted trichomes, and processes for making such fibrous structures.

DETAILED DESCRIPTION OF THE INVENTION

Definitions

Figure 1:
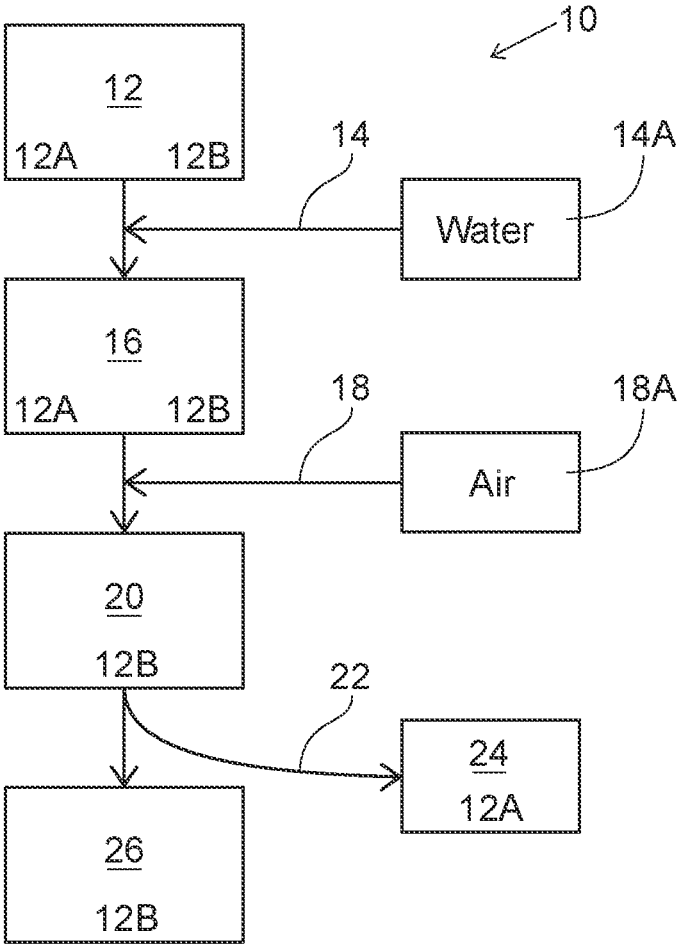
FIG. 1 is a flow chart illustrating an example of a process for extracting trichomes according to the present invention.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials include non-trichome-bearing fragments of the host plant.

In one example of the present invention, the individualized trichomes may be classified to enrich the individualized trichomal content at the expense of mass not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, *sabai*, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Non-trichome materials" as used herein means materials, for example solid materials that are present in mixture with trichomes. For example, non-trichome materials may include dirt, rocks, sticks, bugs, stems and other non-trichome plant fragments and pieces.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, *Hesperaloe*, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of *Acacia, Eucalyptus*, Maple, Oak, Aspen, Birch, Cottonwood, Alder, Ash, Cherry, Elm, Hickory, Poplar, Gum, Walnut, Locust, Sycamore, Beech, *Catalpa, Sassafras, Gmelina, Albizia, Anthocephalus*, and Magnolia. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); polylactic acids, polyhydroxyalkanoates, polycaprolactones, and mixtures thereof. In one example, synthetic fibers may be used as binding agents.

The web (fibrous structure) of the present invention may comprise fibers, films and/or foams that comprises a hydroxyl polymer and optionally a crosslinking system. Non-limiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wisconsin.

Fibrous structures may be comprised of a combination of long fibers and short fibers.

Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers.

"Harvest" or "harvesting" as used herein means a process of gathering mature plants, for example by cutting and then collecting the plants, from a field, which may optionally include moving the plants to a processing operation or storage area.

"Stem" as used herein means a plant's axis that bears buds and shoots with leaves and, at its basal end, roots. In one example, the stem is the stalk of a plant.

"Sifting" and/or "screening" as used herein means a process that separates and retains coarse parts with a sieve and/or screen allowing less coarse parts to pass through the sieve and/or screen.

"Fibrous structure" as used herein means a structure that comprises one or more fibers. Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the Basis Weight Test Method described herein.

The sanitary tissue products of the present invention may exhibit a total dry tensile of at least 150 g/in and/or from about 200 g/in to about 1000 g/in and/or from about 250 g/in to about 850 g/in as measured according to the Tensile Test Method described herein.

In another example, the sanitary tissue product of the present invention may exhibit a total dry tensile of at least 300 g/in and/or at least 350 g/in and/or at least 400 g/in and/or at least 450 g/in and/or at least 500 g/in and/or from about 500 g/in to about 1000 g/in and/or from about 550 g/in to about 850 g/in and/or from about 600 g/in to about 800 g/in as measured according to the Total Dry Tensile Test Method described herein. In one example, the sanitary tissue product exhibits a total dry tensile strength of less than 1000 g/in and/or less than 850 g/in as measured according to the Tensile Test Method described herein.

In another example, the sanitary tissue products of the present invention may exhibit a total dry tensile of at least 500 g/in and/or at least 600 g/in and/or at least 700 g/in and/or at least 800 g/in and/or at least 900 g/in and/or at least 1000 g/in and/or from about 800 g/in to about 5000 g/in and/or from about 900 g/in to about 3000 g/in and/or from about 900 g/in to about 2500 g/in and/or from about 1000 g/in to about 2000 g/in as measured according to the Tensile Test Method described herein.

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero-base standard. The number of panel tests performed and averaged is such that about 0.2 PSU represents a significant difference in subjectively perceived softness.

Trichomes

Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers.

Non-limiting examples of suitable sources for obtaining trichomes, especially trichome fibers, are plants in the *Labiatae* (Lamiaceae) family commonly referred to as the mint family.

Examples of suitable species in the *Labiatae* family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the *Labiatae* family include the *arcticus* subspecies of *Thymus praecox*, commonly referred to as creeping thyme and the *Pseudo lanuginosus* subspecies of *Thymus praecox*, commonly referred to as wooly thyme.

Further examples of suitable species in the *Labiatae* family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the *Labiatae* family include *Lavandula lanata*, commonly referred to as wooly lavender; *Marrubium vulgare*, commonly referred to as horehound; *Plectranthus argentatus*, commonly referred to as silver shield; and *Plectranthus tomentosa*.

Non-limiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii*.

Non-limiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia*.

Non-limiting examples of other suitable sources for obtaining trichomes, especially trichome fibers include *Greyia radlkoferi* and *Greyia flanmaganii* plants in the Greyiaceae family commonly referred to as the wild bottlebrush family.

Non-limiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato.

Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred *anoda* and *Abutilon theophrasti*, commonly referred to as velvetleaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of *renardii* in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, MA.

The trichome-bearing material may be subjected to a mechanical process to liberate its trichomes from its plant epidermis to enrich the pulp or fiber mass' content of individualized trichomes. This may be carried out by means of screening or air classifying equipment well known in the art. A suitable air classifier is the Hosokawa Alpine 50ATP, sold by Hosokawa Micron Powder Systems of Summit, NJ Other suitable classifiers are available from the Minox Siebtechnik.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

In yet another example, a trichome suitable for use in the fibrous structures of the present invention is less hydrophilic that softwood fibers. This characteristic of the trichome may facilitate a reduction in drying temperatures needed to dry fibrous structures comprising such trichome and/or may facilitate making the fibrous structures containing such trichome at a faster rate.

Trichome fibers are greater in length than *Eucalyptus* fibers, but shorter than NSK fibers. However, other properties of trichomes are similar to hardwood fibers, such as *Eucalyptus* fibers, for example softness, and to softwood fibers, such as NSK fibers, for example strength.

Mixture of Trichomes and Non-Trichome Materials

Any suitable method for obtaining a mixture of trichomes and non-trichome materials from a plant source, for example from a *Stachys byzantine* plant (lamb's ear plant) may be used, for example mechanical processes, chemical processes, and/or enzymatic processes. Once a mixture of trichomes and non-trichome materials is obtained, then the process of the present invention for separating the trichomes from the non-trichome materials in the mixture can be used.

Separating Trichomes from a Mixture Comprising Trichomes and Non-Trichome Materials As shown in FIG. 1, the process 10 of the present invention for separating trichomes 12A from a mixture 12 of trichomes 12A and non-trichome materials 12B comprises the steps of:

a. providing a mixture 12 of trichomes 12A and non-trichome materials 12B;
b. adding water 14 from a water source 14A, for example at an amount sufficient to permit the trichomes 12A to float under appropriate conditions, to the mixture 12 to form a slurry 16 comprising the trichomes 12A and non-trichome materials 12B;
c. aerating 18 the slurry 16, for example by introducing air into the slurry 16 from an air source 18A, for example a fan pump; and
d. removing 22 the trichomes 12A from the aerated slurry to form an accept stream 24.

Once the trichomes 12A are removed from the aerated slurry, the aerated slurry will primarily contain the non-trichome materials 12B in a reject stream 26.

Figure 2:
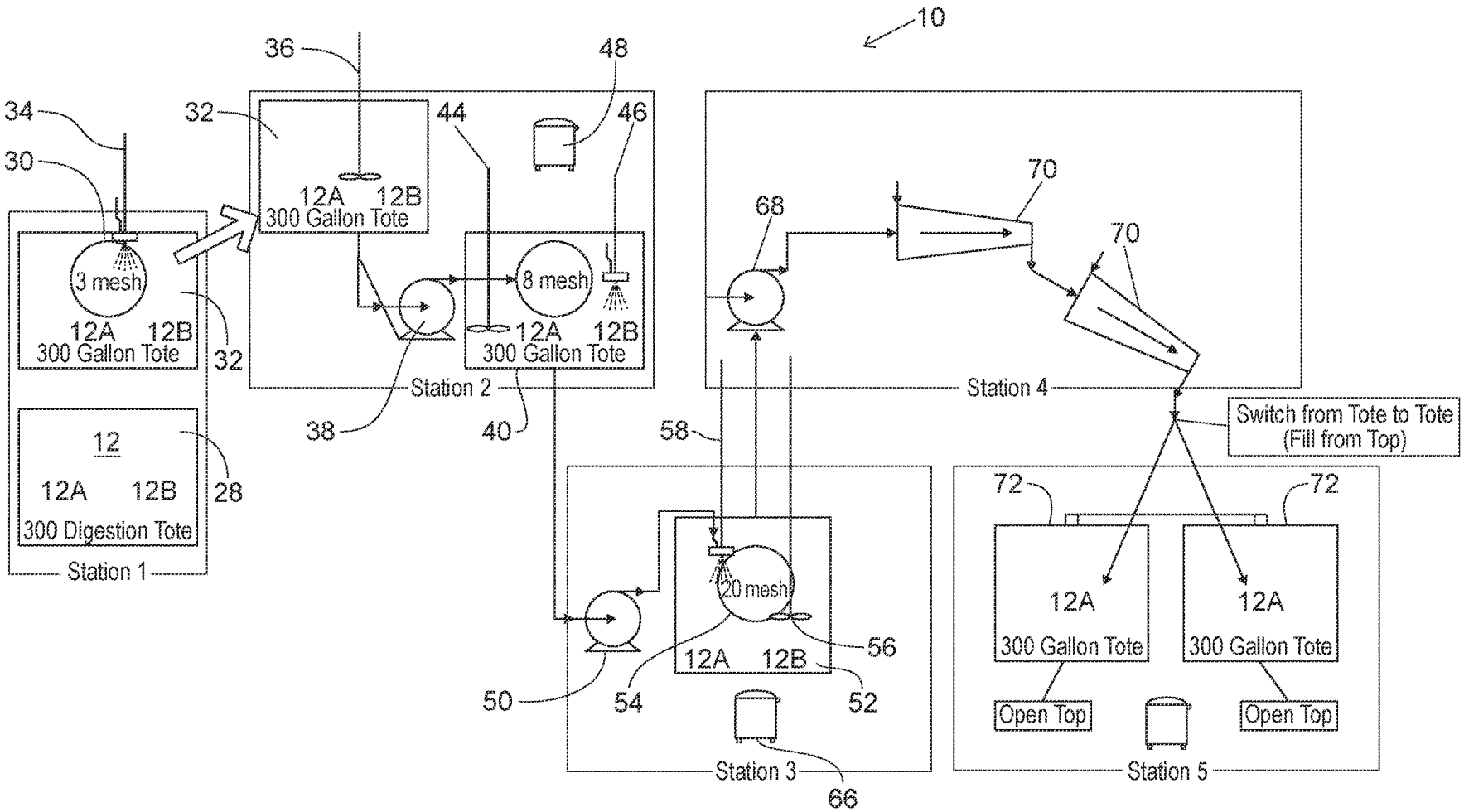
FIG. 2 is a schematic representation of an example of a process for extracting trichomes according to the present invention.

As shown in FIG. 2, in one example, the mixture 12 of trichomes 12A and non-trichome materials 12B may be obtained from a trichome-bearing plant source, such as *Stachys byzantina*, by harvesting the plants from a field. The process of harvesting the plants may result in contaminants that are not part of the trichome-bearing plant source (which includes trichomes and non-trichome materials, such as stems, leaves, and pieces of the plant), for example sticks, grasses, weeds, rocks, dirt, roots, bugs, grasses, and the like. Such contaminants may be removed by adding water to the mixture of contaminants and the trichome-bearing plant source within a container, such as a 300 gallon tote 28. Prior to adding water to the mixture 12 in the tote 28, the mixture 12 may be subjected to one or more enzymes that may initiate the digestion of the trichome-bearing plant source to disassociate the trichomes 12A from the non-trichome materials 12B of the trichome-bearing plant source. A sufficient amount of water is added to the mixture 12 of contaminants and the trichome-bearing plant source such that the trichome-bearing plant source including any trichomes 12A and/or non-trichome materials 12B that have become disassociated from the trichome-bearing plant source and none or at least a portion of the contaminants float in the water. The water may be drained and additional water may be added to result in floating more than one time, for example two or more times. In one example, sufficient amounts of water may be added and drained repeatedly to bring the pH within the tote 28 to a pH of from about 2.5 to about 6. By repeating the water addition and draining, the mixture 12 is sufficiently rinsed to remove any remaining enzymes.

Sieving and/or screening the mixtures step by step with one or more sieves/screens may be used to physically separate larger pieces from smaller pieces, for example trichomes from non-trichome materials. In one example, multiple sieves/screens of reducing opening sizes may be in the physical separation of the components of the mixtures, for example trichomes from the non-trichome materials. In one example, the sieve/screen size may start at 3-Mesh and then to 8-Mesh and then to 20-Mesh. In another example, the sieve/screen size may start at 3-Mesh and then to 5-Mesh and then to 8-Mesh.

A 3-Mesh Screen 30 is used to remove a portion of the mixture 12 (larger pieces) that cannot pass through the 3-Mesh Screen 30 into a new container, for example another 300 gallon tote 32. In one example, the 3-Mesh Screen 30 comprises a single layer/monolayer of the mixture 12, which may be achieved by the flow rate and/or speed of rotation of the 3-Mesh Screen 30.

The material present on the 3-Mesh Screen 30 is then sprayed with water 34, for example individual water jets that are about ⅓ the mesh opening size of the 3-Mesh Screen 30, until the trichomes 12A and non-trichome materials 12B from the trichome-bearing plant source pass through the 3-Mesh Screen 30 into the other tote 32. The remaining material on the 3-Mesh Screen 30, for example the contaminants and any remaining trichome-bearing plant source, is then discarded.

The process of floating material via aeration in the digestion tote 28, removing with a 3-Mesh Screen 30, spraying 34 the material on the 3-Mesh Screen 30 to cause the trichomes 12A and non-trichome materials 12B to pass through to the 300 gallon tote 32, and discarding the remaining material on the 3-Mesh Screen 30 may be repeated multiple times until no remaining trichomes 12A float in the digestion tote 28.

Once the trichomes 12A and non-trichome materials 12B have been collected in the 300 gallon tote 32, additional water is added, for example about 800 liters, to the 300 gallon tote 32 containing the mixture 12 of trichomes 12A and non-trichome materials 12B. This process of transferring the mixture 12 from the digestion tote 28 to the tote 32 containing the mixture 12 of trichomes 12A and non-trichome materials 12B may take about 1 hour to about 3 hours.

The tote 32 containing the mixture 12 of trichomes 12A and non-trichome materials 12B is then processed by adding water, optionally containing a surfactant, and then mixed with a mixer 36, for example an overhead pitch turbine mixture with an impeller, for example an impeller in angle, to homogenously mix the trichomes 12A and non-trichome materials 12B.

The homogenously mixed trichomes 12A and non-trichome materials 12B are then pumped 38, for example via a centrifugal pump, for example operating at a setting of at least 100 rpm and/or at least 200 rpm and/or at least 300 rpm, with a flow rate sufficient to wash the trichomes 12A into another container, for example another 300 gallon tote 40, through an 8-Mesh Screen 42. The 8-Mesh Screen 42 may be rotated, for example at an rpm of from about 2-10 rpm and/or from about 3-7 rpm and/or from about 5 rpm, during the operation. The 8-Mesh Screen 42 may be affixed to the turbine mixer shaft of a mixer 44 in such a way that the 8-Mesh Screen 42 rotates when the turbine mixer shaft rotates on the same centerline. Trichomes 12A and non-trichome materials 12B may be collected on the 8-Mesh Screen 42. Water 46 is then sprayed for example individual water jets that are about ⅓ the mesh opening size of the 8-Mesh Screen 42, onto the material present on the 8-Mesh Screen 42 such that trichomes 12A and non-trichome materials 12B that can pass through the 8-Mesh Screen 42 pass through the 8-Mesh Screen 42 into the tote 40. A vacuum 48 may be used to remove any remaining material from the 8-Mesh Screen 42 that does not pass through the 8-Mesh Screen 42.

The pumping of the trichomes 12A and non-trichome materials 12B from the previous tote 32 to the receiving tote 40 through the 8-Mesh Screen 42 may stop when no additional trichomes 12A are passing through the 8-Mesh Screen 42, for example after 200 liters have been removed from the previous tote 32. In one example, the 8-Mesh Screen 42 comprises a single layer/monolayer of the mixture 12 of trichomes 12A and non-trichome materials 12B, which may be achieved by the flow rate and/or speed of rotation of the 8-Mesh Screen.

The new (receiving) tote 40 is then filled with water to dilute the mixture 12 of trichomes 12A and non-trichome materials 12B to 2:1, for example to about 400 liters in this case.

Then the tote 40 containing the 2:1 diluted mixture 12 of trichomes 12A and non-trichome materials 12B is then processed as follows. Additional water, for example water containing one or more surfactants, is added to the tote 40, for example 20 mL, and a mixer 44, for example an overhead pitch turbine mixer operating at about 60 Hz, mixes the mixture 12 to evenly disperse the trichomes 12A and non-trichome materials 12B within the tote 40. Once evenly dispersed, the mixer 44 is reduced to 30 Hz to prevent balling and/or agglomerating of the trichomes 12A and/or non-trichome materials 12B.

Figure 3:
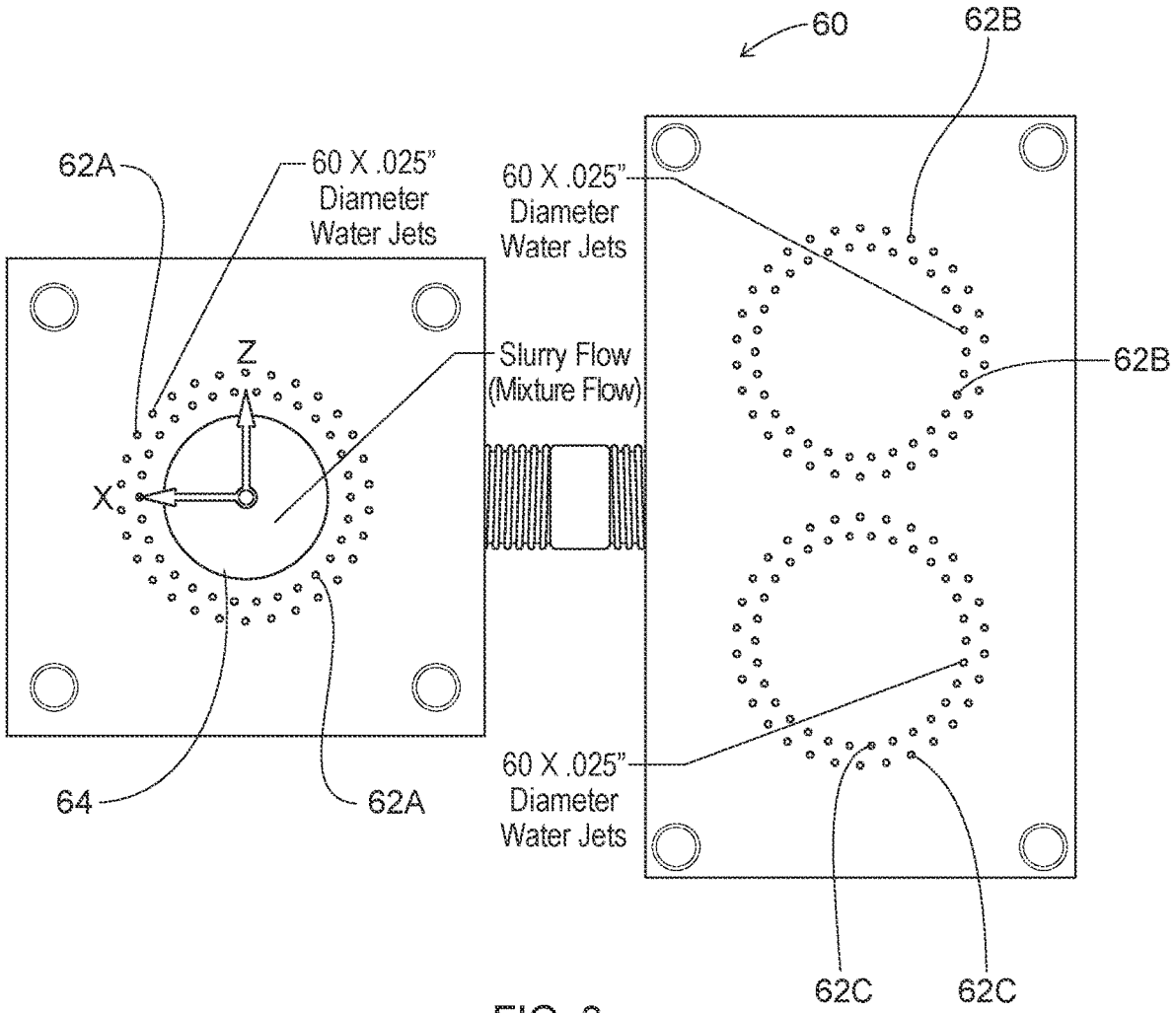
FIG. 3 is a schematic representation of an example of an integrated sprayer.

The dispersed mixture 12 of trichomes 12A and non-trichome materials 12B is then pumped 50, for example via a positive displacement pump, for example operating at a setting of at least 100 rpm and/or at least 200 rpm and/or at least 300 rpm and/or about 325 rpm, with a flow rate sufficient to wash the trichomes 12A into another container, for example another 300 gallon tote 52, through a 20-Mesh Screen 54. The 20-Mesh Screen 54 may be rotated, for example at a setting of 2 on the potentiometer and/or at an rpm of from about 2-10 rpm and/or from about 3-7 rpm and/or from about 5 rpm, during the operation. The 20-Mesh Screen 54 may be affixed to the turbine mixer shaft of a mixer 56 in such a way that the 20-Mesh Screen 54 rotates when the turbine mixer shaft rotates on the same centerline. Trichomes 12A and non-trichome materials 12B may be collected on the 20-Mesh Screen 54. Water 58 is then sprayed for example individual water jets that are about ⅓ the mesh opening size of the 20-Mesh Screen 54, onto the material via an integrated sprayer 60 as shown in FIG. 3, which comprises a plurality of individual water jets 62A, 62B, 62C, and a center opening 64, such that the trichomes 12A and non-trichome materials 12B that can pass through the 20-Mesh Screen 54 pass through the 20-Mesh Screen 54 into the tote 52. The integrated sprayer 60 of FIG. 3 operates such that the dilute mixture 12 of trichomes 12A and non-trichome materials 12B is pumped from the tote 40 and flows through the center opening 64 of the integrated sprayer 60 and individual water jets 62A surround this flow path of the mixture 12. Two additional circular patterns of 0.025" individual water jets 62B and 62C follow the integrated sprayer 60 as the 20-Mesh Screen 54 rotates. The pressure gauge on the water line that supplies water to the integrated sprayer 60 should read about 30 psi while water is being supplied to the integrated sprayer 60. The integrated sprayer 60 should be positioned at the far outer edge of the rotating 20-Mesh Screen 54.

A vacuum 66 may be used to remove any remaining material from the 20-Mesh Screen 54 that does not pass through the 20-Mesh Screen 54.

The pumping of the trichomes 12A and non-trichome materials 12B from the previous tote 40 to the receiving tote 52 through the 20-Mesh Screen 54 may stop when no additional trichomes 12A are passing through the 20-Mesh Screen 54, for example after 400 liters have been removed from the previous tote 40. In one example, the 20-Mesh Screen 54 comprises a single layer/monolayer of the mixture 12 of trichomes 12A and non-trichome materials 12B, which may be achieved by the flow rate and/or speed of rotation of the 20-Mesh Screen 54.

The new (receiving) tote 52 is then filled with water to dilute the mixture 12, which already contains surfactant(s) from previous steps, of trichomes 12A and non-trichome materials 12B to 4:1 and/or 8:1, for example to about 800 liters in this case.

The trichomes 12A may be removed from this tote 52 after they have floated to the top of the tote 52 resulting in an accept stream of trichomes 12A. Air from air source may be added to the tote 52 to facilitate floating of the trichomes 12A and allow for removal of the trichomes 12A from the tote 52. This step can be repeated multiple times. The trichomes 12A tend to float due to their hollow structure or lumen. Once removed, the trichomes 12A may be dried and prepared for further use, such as inclusion in fibrous structures, for example wet-laid and/or air-laid and/or co-form fibrous structures.

The remaining material within the tote 52 may be recycled and/or reprocessed though this separation process to remove any residual trichomes 12A.

In one example, to facilitate further removal of trichomes 12A from the mixture 12 of trichomes 12A and non-trichome materials 12B, water, for example water containing one or more surfactants (about 20 mL) may be added to the dilute (4:1 and/or 8:1) mixture 12 of trichomes 12A and non-trichome materials 12B. Then the dilute mixture 12 may be pumped 68, via a positive displacement pump, to one or more hydrocyclones 70 in series. The mixture 12 may pass through the hydrocyclones 70 at a throughput of about 30 gpm. A reject stream of non-trichome material 12B of about 1.2 to about 1.8 gpm will maintain about a 20-60 psi and/or 30-40 psi pressure drop across the hydrocyclones 70. The accept stream of trichomes 12A exits the hydrocyclones 70 and can be directed into one or more containers, for example 300 gallon totes 72 from which the trichomes 12A can be removed upon floating.

In one example, one or more of the rotating screens described above may be replaced with a screen conveyor.

The aeration process steps of the present invention may use a Dissolved Air Floatation (DAF) unit. The dissolved air used to aerate may comprise air bubbles.

In one example, the removal of contaminants such as sticks, rocks, dirt, and the like may be accomplished by passing the material through a grape destemmer.

Water (Optionally with Surfactants)

The water added to the mixture of trichomes and non-trichome materials in the process of the present invention may comprise one or more surfactants, for example one or more anionic surfactants, one or more amphoteric surfactants, one or more nonionic surfactants, and/or one or more cationic surfactants. In one example, the water comprises an anionic surfactant, for example an alkyl ethoxy sulfate, such as $AE_{0.6}S$, and an amphoteric surfactant, for example amine oxide. In one example, the water comprises two or more surfactants. Suitable surfactants, discussed below, include anionic surfactants (such as sulfate surfactants, sulfonate surfactants), nonionic surfactants, zwitterionic surfactants, amphoteric surfactants or combinations thereof.

The surfactants present in the water may include sulfate surfactants, for example alkyl ethoxy sulfate surfactants, sulfonate surfactants, for example alkyl benzene sulfonate surfactants, amphoteric surfactants, for example amine oxide surfactants, and nonionic surfactants, for example alcohol alkoxylated surfactants.

a. Sulfate Surfactants

Suitable sulfate surfactants for use herein include water-soluble salts of $C_8$-$C_{18}$ alkyl or hydroxyalkyl, sulfate and/or ether sulfate. Suitable counterions include alkali metal cation or ammonium or substituted ammonium, or sodium.

The sulfate surfactants may be selected from $C_8$-$C_{18}$ primary, branched chain and random alkyl sulfates (AS); $C_8$-$C_{18}$ secondary (2,3) alkyl sulfates; $C_8$-$C_{18}$ alkyl alkoxy sulfates (AExS) wherein x may be from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees, examples are those based on NEODOL® alcohols available from Shell Chemicals, LIAL®-ISALCHEM® and SAFOL® available from Sasol, and/or natural alcohols available from The Procter & Gamble Chemicals Company.

In an embodiment, the water may comprise an anionic surfactant having at least 50%, or at least 60% or at least 70% of a sulfate surfactant by weight of the anionic surfactant. In one non-limiting example, the sulfate surfactant is selected from the group consisting of alkyl sulfate, alkyl ethoxy sulfates and mixtures thereof. In a further embodiment, the anionic surfactant has a degree of ethoxylation of from about 0.2 to about 3, or from about 0.3 to about 2, or from about 0.4 to about 1.5, or about 0.4 to about 1. In yet another non-limiting example, the anionic surfactant has a level of branching of from about 5% to about 40%, or from about 10% to 35%, or from about 20% to about 30%.

b. Sulfonate Surfactants

Suitable sulfonate surfactants for use herein include water-soluble salts of $C_8$-$C_{18}$ alkyl or hydroxyalkyl sulfonates; $C_{11}$-$C_{18}$ alkyl benzene sulfonates (LAS), modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS). Those also include the paraffin sulfonates may be monosulfonates and/or disulfonates, obtained by sulphonating paraffins of 10 to 20 carbon atoms. The sulfonate surfactants also include the alkyl glyceryl sulfonate surfactants.

c. Amphoteric Surfactant

Suitable amphoteric surfactants include amine oxides and betaines, including amine oxides.

Suitable amine oxides are alkyl dimethyl amine oxide or alkyl amido propyl dimethyl amine oxide. Amine oxide may have a linear or mid-branched alkyl moiety. Typical linear amine oxides include water-soluble amine oxides containing one $C_{8-18}$ alkyl moiety and two moieties selected from the group consisting of $C_{1-3}$ alkyl groups and $C_{1-3}$ hydroxyalkyl groups. In an embodiment, amine oxide is characterized by the formula R1-N(R2)(R3)O wherein R1 is a $C_{8-18}$ alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, or from 12 to 20, and or from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, or equal to 4, and/or from 0 to 4 carbon atoms in at least 50 wt %, or at least 75 wt % to 100 wt % of the mid-branched amine oxides for use herein.

The amine oxide may further comprise two moieties, independently selected from a $C_{1-3}$ alkyl, a $C_{1-3}$ hydroxyalkyl group, or a polyethylene oxide group containing an average of from about 1 to about 3 ethylene oxide groups. The two moieties may be selected from a $C_{1-3}$ alkyl, or both may be selected as a $C_1$ alkyl.

d. Nonionic Surfactants

The water of the present invention may further comprise a nonionic surfactant, such as an alcohol alkoxylate. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. One non-limiting example of suitable nonionic surfactants are the condensation products of alcohols having an alkyl group containing from 10 to 18 carbon atoms, or from 10 to 15 carbon atoms with from 2 to 18 moles, or 2 to 15 moles, or 5-12 moles of ethylene oxide per mole of alcohol.

Anionic to Amphoteric Ratio

The anionic and amphoteric surfactants may be present in the water and/or slurry from at a weight ratio of from about 1:1 to about 8.5:1, or at a ratio of at least 1:1 and/or greater than 1:1 and/or greater than 1.5:1 and/or greater than 2:1 to less than 6:1 and/or less than 5:1 and/or less than 4.5:1.

Fibrous Structures

The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$.

In yet another example, the fibrous structures of the present invention may comprise a plurality of pulp fibers, wherein greater than 0% but less than 20% by weight on a dry fiber basis of the pulp fibers are softwood fibers and wherein the fibrous structure comprises pulp fibers derived from a pulp fiber-producing source that has a growing cycle of less than 800 and/or every 400 and/or every 200 and/or every 100 or less days.

The fibrous structures of the present invention may comprise one or more individualized trichomes, especially trichome fibers. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 90% and/or from about 0.5% to about 80% and/or from about 0.5% to about 50% and/or from about 1% to about 40% and/or from about 2% to about 30% and/or from about 5% to about 25% by weight on a dry fiber basis of trichome fibers. In one example, the fibrous structures of the present invention comprise at least 1% and/or at least 3.5% and/or at least 5% and/or at least 7.5% and/or at least 10% by weight on a dry fiber basis of trichome fibers.

In addition to a trichome, the fibrous structure may comprise other additives, such as wet strength additives, softening additives, solid additives (such as starch, clays), dry strength resins, wetting agents, lint resisting and/or reducing agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

The use of trichomes (trichome fibers) in the fibrous structure making process permits the reduction of softwood fibers in the fibrous structure. In one example, the inclusion of trichome fibers permits at least a 5% by weight on a dry fiber basis reduction of softwood fibers while maintaining a total dry tensile strength of greater than 500 g/in and/or greater than 520 g/in and increasing the softness (PSU) to at least 0.67 and/or at least 1.00.

In one example, the replacement of softwood fibers with trichome fibers produces a fibrous structure and/or sanitary tissue product that exhibits a softness (PSU) increase of at least 0.5 and/or at least 0.67 and/or at least 1.00 compared to the same fibrous structure and/or sanitary tissue product without the trichome fibers.

In addition to the reduction of softwood fibers, the inclusion of trichome fibers, may result, especially when they are added to an outer layer or in a homogeneous fibrous structure, in a surface that has a "fuzzy" feel to consumers. In addition, the trichome fibers may also provide surface smoothness increases, strength increases and flexibility increases to the fibrous structures.

Processes for Making Trichome-Containing Fibrous Structures

Any suitable process for making fibrous structures known in the art may be used to make trichome-containing fibrous structures of the present invention so long as the extracted trichomes of the present invention are used and/or the fibrous structure made exhibits the properties of the fibrous structures of the present invention.

In one example, the trichome-containing fibrous structures of the present invention are made by a wet laid fibrous structure making process.

In another example, the trichome-containing fibrous structures of the present invention are made by an air laid fibrous structure making process.

In one example, a trichome-containing fibrous structure is made by the process comprising the steps of: a) preparing a fiber furnish (slurry) by mixing a trichome with water; b) depositing the fiber furnish on a foraminous forming surface to form an embryonic fibrous web; and c) drying the embryonic fibrous web.

In one example, a fiber furnish comprising a trichome, such as a trichome fiber, is deposited onto a foraminous forming surface via a headbox.

In one example, a process for making a fibrous structure comprises the steps of:

a. providing a fiber furnish comprising extracted trichomes according to the present invention;
b. depositing the fiber furnish on a foraminous forming surface to form an embryonic fibrous web; and
c. drying the embryonic fibrous web to form a fibrous structure.

The fiber furnish may further comprise wood pulp fibers. The wood pulp fibers may be selected from the group consisting of: hardwood pulp fibers, softwood pulp fibers, and mixtures thereof. In one example, the hardwood pulp fibers comprise *Eucalyptus* pulp fibers. In one example, the softwood pulp fibers comprise Northern Softwood Kraft pulp fibers (NSK pulp fibers). The fiber furnish may further comprise other wood and/or non-wood pulp fibers such as bamboo fibers.

In another example, a fibrous structure according to the present invention comprises a plurality of extracted trichomes according to the present invention such that the fibrous structure is substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Fibrous Structure Purity Test Method.

In another example, the fibrous structure of the present invention may comprise a plurality of extracted trichomes such that the total non-trichome materials present in the fibrous structure exhibits a total surface area of less than 0.2% and/or less than 0.17% and/or less than 0.15% and/or less than 0.12% and/or less than 0.1% and/or less than 0.09% and/or less than 0.08% as measured according to the Fibrous Structure Purity Test Method.

In still another example, a fibrous structure of the present invention may comprise a plurality of individualized trichomes such that the fibrous structure is substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Fibrous Structure Purity Test Method.

In yet another example, the fibrous structure of the present invention may comprise a plurality of individualized trichomes such that the total non-trichome materials present in the fibrous structure exhibits a total surface area of less than 0.2% and/or less than 0.17% and/or less than 0.15% and/or less than 0.12% and/or less than 0.1% and/or less than 0.09% and/or less than 0.08% as measured according to the Fibrous Structure Purity Test Method.

In one example, one or more of the trichomes (extracted trichomes and/or individualized trichomes) used to make the fibrous structures of the present invention are derived from a plant in the *Stachys* genus, for example *Stachys byzantina.*

In yet another example, the fibrous structures of the present invention comprising trichomes (extracted trichomes and/or individualized trichomes) may exhibit a softness (PSU) increase of at least 0.5 compared to the fibrous structures without the trichomes (extracted trichomes and/or individualized trichomes).

Further, the fibrous structures of the present invention may further comprise wood pulp fibers, for example softwood pulp fibers, hardwood pulp fibers, and mixtures thereof. In one example, the softwood pulp fibers are selected from the group consisting of: southern softwood kraft pulp fibers, northern softwood kraft pulp fibers, and mixtures thereof. In one example, the hardwood pulp fibers are selected from the group consisting of: northern hardwood pulp fibers, tropical hardwood pulp fibers, and mixtures thereof. The tropical hardwood fibers may be selected from the group consisting of: *eucalyptus* fibers, *acacia* fibers, and mixtures thereof. In one example, the hardwood pulp fibers are derived from a fiber source selected from the group consisting of: *Acacia, Eucalyptus*, Maple, Oak, Aspen, Birch, Cottonwood, Alder, Ash, Cherry, Elm, Hickory, Poplar, Gum, Walnut, Locust, Sycamore, Beech, *Catalpa, Sassafras, Gmelina, Albizia, Anthocephalus, Magnolia*, and mixtures thereof.

In one example, the fibrous structures of the present invention comprise less than 100% and/or less than 90% and/or less than 80% and/or less than 70% and/or less than 60% and/or less than 50% and/or less than 40% and/or less than 30% and/or less than 20% and/or less than 10% and/or less than 5% and/or less than 3% by weight on a dry fiber basis of hardwood pulp fibers. In another example, the fibrous structures of the present invention are void of hardwood pulp fibers.

In another example, the fibrous structures of the present invention may further comprise one or more synthetic fibers.

The fibrous structures of the present invention may further comprise one or more optional additives, for example a softening agent. Non-limiting examples of suitable softening agents include quaternary ammonium compounds, silicones, and mixtures thereof.

The fibrous structures of the present invention may exhibit a Basis Weight of greater than 10 $g/m^2$ as measured according to the Basis Weight Test Method.

In one example, the fibrous structure of the present invention is a through-air-dried fibrous structure.

In one example, the fibrous structure of the present invention is an uncreped through-air-dried fibrous structure.

In one example, the fibrous structure of the present invention is a conventional fibrous structure.

In one example, the fibrous structure of the present invention is a creped fibrous structure.

In one example, the fibrous structure of the present invention is a fabric creped fibrous structure.

In one example, the fibrous structure of the present invention is a belt creped fibrous structure.

In one example, the fibrous structure of the present invention is an uncreped fibrous structure.

In one example, the fibrous structure of the present invention is an embossed fibrous structure.

In one example, the fibrous structure of the present invention is a wet-molded fibrous structure.

Non-Limiting Examples

This following example illustrates a non-limiting example for the preparation of a fibrous structure according to the present invention on a pilot-scale Fourdrinier paper making machine with the addition of trichome fibers providing a strength increase.

The following Example illustrates a non-limiting example for the preparation of sanitary tissue product comprising a fibrous structure according to the present invention on a pilot-scale Fourdrinier fibrous structure making machine.

Individualized trichome are first prepared from *Stachys byzantina* bloom stalks consisting of the dried stems, leaves, and pre-flowering buds, by passing dried *Stachys byzantina* plant matter through a knife cutter (Wiley mill, manufactured by the C. W. Brabender Co. located in South Hackensack, NJ) equipped with an attrition screen having ¼" holes. Exiting the Wiley mill is a composite fluff constituting the individualized trichome fibers together with chunks of leaf and stem material. The individualized trichomes are then subjected to a sifting operation and then the individualized trichome fluff is then passed through a classification operation, for example a hydrocyclone; the "accepts" or "fine" fraction from the hydrocyclone is greatly enriched in individualized trichome fibers while the "rejects" or "coarse" fraction is primarily chunks of stalks, and leaf elements with only a minor fraction of individualized trichome fibers. The individualized trichomes are then passed through a slotted pressure screen (UV100 from Kadant Black Clawson of Mason, Ohio). The resulting individualized trichome material (fines) is mixed with a 10% aqueous dispersion of "Texcare 4060" to add about 10% by weight "Texcare 4060" by weight of the bone dry weight of the individualized trichomes followed by slurrying the "Texcare"-treated trichome in water at 3% consistency using a conventional repulper. This slurry is passed through a stock pipe toward another stock pipe containing a *eucalyptus* fiber slurry.

Special care must be taken while processing the trichomes. 60 lbs. of trichome fiber is pulped in a 50 gallon pulper by adding water in half amount required to make a 1% trichome fiber slurry. This is done to prevent trichome fibers over flowing and floating on surface of the water due to lower density and hydrophobic nature of the trichome fiber. After mixing and stirring a few minutes, the pulper is stopped and the remaining trichome fibers are pushed in while water is added. After pH adjustment, it is pulped for 20 minutes, then dumped in a separate chest for delivery onto the machine headbox. This allows one to place trichome fibers in one or more layers, alone or mixed with other fibers, such as hardwood fibers and/or softwood fibers. During this particular run, the trichome fibers are added exclusively on the wire outer layer as the product is converted wire side up; therefore it is desirable to add the trichome fibers to the wire side (the side where the tactile feel senses paper the most).

The aqueous slurry of *eucalyptus* fibers is prepared at about 3% by weight using a conventional repulper. This slurry is also passed through a stock pipe toward the stock pipe containing the trichome fiber slurry.

The 1% trichome fiber slurry is combined with the 3% *eucalyptus* fiber slurry in a proportion which yields about 13.3% trichome fibers and 86.7% *eucalyptus* fibers. The stockpipe containing the combined trichome and *eucalyptus* fiber slurries is directed toward the wire layer of headbox of a Fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The trichome fiber and *eucalyptus* fiber slurry is diluted with white water at the inlet of a fan pump to a consistency of about 0.15% based on the total weight of the *eucalyptus* and trichome fiber slurry. The NSK fibers, likewise, are diluted with white water at the inlet of a fan pump to a consistency of about 0.15% based on the total weight of the NSK fiber slurry. The *eucalyptus*/trichome fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam.

The fibrous structure making machine has a layered headbox having a top chamber, a center chamber, and a bottom chamber. The *eucalyptus*/trichome combined fiber slurry is pumped through the top headbox chamber, *eucalyptus* fiber slurry is pumped through the bottom headbox chamber, and, simultaneously, the NSK fiber slurry is pumped through the center headbox chamber and delivered in superposed relation onto the Fourdrinier wire to form thereon a three-layer embryonic web, of which about 83% is made up of the *eucalyptus*/trichome fibers and 17% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$.

5% by weight of trichome fibers on the outer layer of the sheet produced a product with considerable softness. To control tensile, softwood fibers had to be removed by 7% to compensate for 5% addition of trichome fibers. The base product had a softness of −0.44 PSU compared to our standard but the fibrous structure made with trichome fibers had 1.05 PSU at a comparable wet and dry tensile. Adjusting for the base softness deficit the condition with trichome fibers softness would be at about 1.5 PSU. Other benefits of trichome fiber addition is that the pre-dryer temperatures may be reduced by at least 30° F., and in one example at least 30° F. to about 50° F. This is a significant temperature reduction that can be used for energy saving or increase machine capacity if it is drying limited. In addition to the benefits described above, the use of trichome fibers to reduce the use of pulp fibers, especially softwood pulp fibers, in making fibrous structures, such as sanitary tissue products, also has environmental benefits, such as reducing carbon footprint of fibrous structures, especially paper products that have historically been made from wood pulp, by reducing the usage wood pulp and thus tree usage while maintaining or increasing the softness of the fibrous structures. In addition, as is always clear from the above description, the use of trichome fibers in fibrous structure breaks the strength/softness contradiction that has historically plagued the fibrous structure, especially the sanitary tissue product industry by increasing strength while increasing softness of the fibrous structure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for extracting trichomes from non-trichome materials, the process comprising the steps of:

providing a mixture of trichomes and non-trichome materials by separation from a plant source;

adding water to float a first floatable portion of the mixture;

removing at least a portion of the first floatable portion;

using air to float a second floatable portion of the mixture; and removing at least a portion of the second floatable portion.

2. The process according to claim 1 wherein the process further comprises the step of adding one or more surfactants to the mixture.

3. The process according to claim 2 wherein at least one of the surfactants is present in the water.

4. The process according to claim 2 wherein at least one of the surfactants comprises a surfactant selected from the group consisting of: anionic surfactants, amphoteric surfactants, nonionic surfactants, zwitterionic surfactants, cationic surfactants, and mixtures thereof.

5. The process according to claim 4, wherein at least one of the surfactants comprises a surfactant selected from the group consisting of: anionic surfactants, amphoteric surfactants, and mixtures thereof.

6. The process according to claim 2 wherein at least one of the surfactants comprises an anionic surfactant.

7. The process according to claim 6 wherein the anionic surfactant comprises an alkyl sulfate and/or an alkyl ethoxy sulfate.

8. The process according to claim 6 wherein the anionic surfactant comprises an alkyl sulfonate.

9. The process according to claim 2 wherein at least one of the surfactants comprises an amphoteric surfactant.

10. The process according to claim 9 wherein the amphoteric surfactant comprises an amine oxide.

11. The process according to claim 2 wherein at least one of the surfactants comprises a nonionic surfactant.

12. The process according to claim 11 wherein the nonionic surfactant comprises an alcohol alkoxylate.

13. The process according to claim 2 wherein process comprise the step of adding two or more surfactants to a slurry comprising the mixture.

14. The process according to claim 13 wherein at least one of the surfactants is an anionic surfactant and at least one of the surfactants is an amphoteric surfactant.

15. The process according to claim 14 wherein the anionic surfactant and amphoteric surfactant are present at a weight ratio of from about 1:1 to about 8.5:1.

16. The process according to claim 1 wherein the trichomes are physically separated from the non-trichome materials by floating the trichomes within a slurry of the mixture.

17. The process according to claim 1 wherein the trichomes are physically separated from the non-trichome materials by passing a slurry of the mixture through one or more sieves.

18. The process according to claim 17 wherein the sieve opening size is reduced from step to step.

19. The process according to claim 1, wherein the addition of water to the mixture results in the formation of a slurry, and wherein the air is used to float a portion of the slurry.

20. The process according to claim 1, wherein the step of using air to float a second floatable portion of the mixture is achieved by use of a dissolved air floatation unit.

* * * * *